US008695332B2

(12) United States Patent
Smith et al.

(10) Patent No.: US 8,695,332 B2
(45) **Date of Patent: *Apr. 15, 2014**

(54) INTERNAL BYPASS EXHAUST GAS COOLER

(75) Inventors: Willi J. Smith, Torrance, CA (US); Jon A. Sayers, Nuneaton (GB)

(73) Assignee: Honeywell International Inc., Morristown, NJ (US)

( * ) Notice: Subject to any disclaimer, the term of this patent is extended or adjusted under 35 U.S.C. 154(b) by 232 days.

This patent is subject to a terminal disclaimer.

(21) Appl. No.: 12/927,941

(22) Filed: Nov. 29, 2010

(65) Prior Publication Data

US 2011/0099973 A1 May 5, 2011

Related U.S. Application Data

(63) Continuation of application No. 10/570,675, filed as application No. PCT/GB03/04497 on Oct. 17, 2003, now Pat. No. 7,845,338.

(51) Int. Cl.

| | |
|---|---|
| ***F01N 5/02*** | (2006.01) |
| ***F02M 25/06*** | (2006.01) |
| ***F01N 1/00*** | (2006.01) |
| ***F02B 47/08*** | (2006.01) |
| ***F02M 25/07*** | (2006.01) |
| ***F28F 27/02*** | (2006.01) |

(52) U.S. Cl.
USPC ..... 60/320; 60/278; 60/322; 60/324; 123/568.12; 165/103

(58) Field of Classification Search
USPC ..... 60/273, 278, 320–322, 324; 123/568.12; 165/42, 103, DIG. 110, 165/DIG. 113
See application file for complete search history.

(56) References Cited

U.S. PATENT DOCUMENTS

| | | | |
|---|---|---|---|
| 2,488,807 | A | 11/1949 | Currie |
| 3,904,374 | A | 9/1975 | Rosenlund |
| 4,020,809 | A | 5/1977 | Kern et al. |
| 4,993,367 | A | 2/1991 | Kehrer |

(Continued)

FOREIGN PATENT DOCUMENTS

| | | |
|---|---|---|
| DE | 914450 | 7/1954 |
| DE | 29611034 | 6/1996 |

(Continued)

OTHER PUBLICATIONS

PCT International Search Report for PCT/GB2003/004497, dated Jun. 30, 2004 for PCT application corresponding to U.S. Appl. No. 10/570,675, parent of the present application.

(Continued)

*Primary Examiner* — Audrey K Bradley
(74) *Attorney, Agent, or Firm* — John Griecci

(57) ABSTRACT

An exhaust gas cooler assembly with an internally located bypass tube, spaced apart from and disposed within a core passage, with an exhaust gas inlet manifold directing exhaust gas to a plurality of cooling passages, or to the bypass tube by means of control valves. Further provided is a detachable valve cartridge with an actuator, with all moving components being included within the valve cartridge and actuator.

16 Claims, 6 Drawing Sheets

(56) References Cited

U.S. PATENT DOCUMENTS

| | | | |
|---|---|---|---|
| 5,305,603 | A | 4/1994 | Baumann |
| 5,331,810 | A | 7/1994 | Ingermann et al. |
| 5,427,141 | A | 6/1995 | Ohtsubo |
| 5,606,857 | A | 3/1997 | Harada |
| 5,617,726 | A | 4/1997 | Sheridan et al. |
| 6,401,451 | B1 | 6/2002 | Yasui et al. |
| 6,584,767 | B1 | 7/2003 | Koenig |
| 6,976,480 | B2 | 12/2005 | Miyoshi et al. |
| 2001/0054285 | A1 | 12/2001 | Ohmori et al. |
| 2003/0015184 | A1 | 1/2003 | Klipfel et al. |

FOREIGN PATENT DOCUMENTS

| | | | |
|---|---|---|---|
| DE | 29714478 | | 1/1997 |
| DE | 10251179 | | 10/2002 |
| EP | 1096131 | A1 | 5/2001 |
| EP | 1277945 | A1 | 1/2003 |
| EP | 1288543 | A1 | 3/2003 |
| EP | 1291509 | A2 | 3/2003 |
| WO | WO 02/052142 | A1 | 7/2002 |
| WO | WO 2004/040109 | A1 | 5/2004 |

OTHER PUBLICATIONS

EPO Communication, extended European Search Report in corresponding application EP 10075392.0, dated Nov. 9, 2010.

INTERNAL BYPASS EXHAUST GAS COOLER

This application is a Continuation Application of U.S. application Ser. No. 10/570,675, filed Dec. 28, 2006 now U.S. Pat. No. 7,845,338, which claims the benefit of the filing of International Application PCT/GB03/04497, filed Oct. 17, 2003, both of which are incorporated herein by reference for all purposes.

BACKGROUND OF THE INVENTION

The present invention relates to an exhaust gas cooler component of an exhaust gas recirculation (EGR) system for an internal combustion engine, and more particularly to an exhaust gas cooler with an internal bypass, and optionally with a concentric flow gas intake manifold and valve mechanism.

EGR systems recirculate at least a portion of the engine exhaust gases into the engine air intake system for the purpose of reducing NOx emissions. Exhaust gas coolers are used to cool a portion of the exhaust gas. Typical prior art exhaust gas coolers are cylindrical shells that define a coolant chamber within the shell. In one prior art embodiment, the engine coolant is caused to flow through the shell, thereby providing a coolant liquid for use in heat exchange. A plurality of small diameter gas cooling passages, such as tubes, transit the length of shell, with each such passage surrounded by the coolant liquid. Thus the exhaust gas is directed through the plurality of small diameter gas cooling passages, and a portion of the heat of the exhaust gas is transferred to the coolant liquid during passage of the exhaust gas through the exhaust gas cooler. The cylindrical shell defining the exhaust gas cooler may have a circular tube plate at each end, sealing the cylindrical tube. The circular tube plates may further have a plurality of holes for receiving, at each end, the plurality of small diameter exhaust gas passages.

As emissions regulations become more stringent, one of the methods of maintaining compliance is to use a bypass exhaust gas cooler which can vary cooling performance depending upon system requirements. For example, at certain times, such as during engine start-up, it is preferable to stop the exhaust gases from being cooled. It is known to utilize an exhaust gas cooler with a separate bypass tube external to the exhaust gas cooler, typically with a valve arrangement, so that exhaust gases can be diverted around the exhaust gas cooler when cooling is not required. This provides a cooling circuit, in which exhaust gas is cooled, and a bypass circuit, in which exhaust gas is not cooled. However, use of a separate bypass tube external to the exhaust gas cooler adds a bulky component to the engine compartment. Particularly with the frequently cramped layout of the engine compartment of a road vehicle, space is at a premium and thus adding a separate bypass tube is not desirable. Additionally, because of the differential rates of expansion and contraction of the exhaust gas cooler and the separate bypass tube during operation, it is necessary to include an expansion means, such as a bellows, to the external bypass tube. This adds to the complexity of construction, adds additional cost, and provides a component that is subject to failure.

It is also known to employ an exhaust gas cooler which diverts all or a portion of the exhaust gas prior to delivery of the exhaust gas to the exhaust gas cooler. For example, one such device employs an exhaust gas cooler which, rather than a cylindrical shell in which gas transits the length of the shell and exits from the end opposite the entrance, has the exhaust gas entrance and exhaust gas exit on the same end, with the exhaust gas reversing direction within the exhaust gas cooler.

However, this type of exhaust gas cooler is frequently more bulky than other forms of exhaust gas coolers in which the exhaust gas entrance and exit are on opposite ends. Additionally, this type of exhaust gas cooler requires a redesign of the exhaust gas flow circuit within the engine compartment, is not readily amenable to retrofitting existing engines, and can require significant modifications to engine layouts.

It is advantageous to have an exhaust gas cooler which can be employed such that all exhaust gas is cooled, no exhaust gas is cooled, or only a portion of the exhaust is cooled. Thus in order to provide optimal performance it is advantageous to have an exhaust gas cooler in which not only can the bypass circuit be opened, but also the cooling circuit can be simultaneously physically closed, thereby preventing any exhaust gas cooling in the event that all exhaust gas is diverted to the bypass circuit.

In typical exhaust gas coolers with some form of bypass, the valve assembly for directing exhaust gas to either the cooler circuit or the bypass circuit is an integral part of the exhaust gas cooler or a manifold connected to the exhaust gas cooler. Typically valve components are the only moving parts within the exhaust gas cooler circuit, and include components which are welded or brazed. Because the valve components are movable and actuated by some form of actuator, the components are prone to mechanical failure. However, because of the design of typical exhaust gas coolers, either the entire exhaust gas cooler, or alternatively a manifold or similar component, must be replaced in the event of failure of the valve components. This design adds to costs of construction, since welding or brazing must be performed on a relatively large component, and further increases costs of maintenance, since large components must be replaced in the event of failure of a relatively small sub-component.

BRIEF SUMMARY OF THE INVENTION

The invention provides an exhaust gas cooler assembly including a cooler shell with a first end with a cooler inlet proximate the first end and a second end with a cooler outlet proximate the second end; a plurality of gas cooling passages extending from the first end of the cooler shell to the second end of the cooler shell; a core passage extending from the first end of the cooler shell to the second end of the cooler shell; a bypass tube disposed within and spaced apart from the core passage; an inlet exhaust gas manifold at the first end of the cooler shell and separately in fluidic connection with the plurality of gas cooling passages and the bypass tube; and a valve assembly for selectably controlling an exhaust gas flow to the plurality of gas cooling passages, to the bypass tube, or to a combination thereof. In one embodiment, the gas cooling passages may be parallel to each other and disposed in a concentric array with the core passage centrally disposed within the concentric array of parallel gas cooling passages. The concentric array of parallel gas cooling passages may be a single concentric ring of gas cooling passages or more than one concentric ring of gas cooling passages.

The inlet exhaust gas manifold of the exhaust gas cooler can include a central flow portion in fluidic connection with the bypass tube and a toroidal flow portion in fluidic connection with the plurality of parallel gas cooling passages. Thus there may be provided a first flow conduit in fluidic connection with the central flow portion and a parallel second flow conduit in fluidic connection with the toroidal flow portion. The valve assembly may control flow at the first flow conduit and the second flow conduit. In one embodiment, the valve assembly includes two coaxial butterfly valves, with a first butterfly valve disposed within the first flow conduit and a second butterfly valve disposed within the second flow conduit. The two coaxial butterfly valves may share a common shaft, with the first butterfly valve disposed on the common shaft at a right angle to the second butterfly valve. The valve assembly may be removably engageable from the exhaust gas cooler assembly.

In the exhaust gas cooler assembly, the bypass tube may be connectably engaged to the inlet exhaust gas manifold in a position such that the bypass tube is held spaced apart from the core passage. The bypass tube may also be spaced apart from the core passage by at least three spacers disposed around at least one end of the bypass tube and in contact with the core passage. In another embodiment, the bypass tube is spaced apart from the core passage by at least three spacers disposed around each end of the bypass tube and in contact with the core passage.

The invention further provides an inlet exhaust gas manifold for a generally cylindrical exhaust gas cooler that has a plurality of parallel gas cooling passages arrayed in a ring and a centrally located bypass tube, wherein the manifold includes a first flow conduit in fluidic connection with the bypass tube and a second flow conduit, parallel to the first flow conduit, in fluidic connection with a toroidal conduit, the toroidal conduit being in fluidic connection with the plurality of gas cooling passages. The inlet exhaust gas manifold can further include a valve assembly controlling flow within the first flow conduit and the second flow conduit, and can further include a single axial shaft with a first butterfly valve disposed on the shaft and positioned to control flow within the first flow conduit and a second butterfly valve disposed on the shaft at a right angle to the first butterfly valve and positioned to control flow within the second flow conduit. The valve assembly of the exhaust gas manifold can be actuated by applying a rotational force to the spindle. The manifold can further include actuator for actuating the valve assembly. In one embodiment, the valve assembly is removably engageable from the manifold.

The invention further provides a method of controlling exhaust gas temperature within an exhaust gas recirculation circuit, which method includes the steps of providing a generally cylindrical gas cooler with a plurality of parallel gas cooling passages arrayed in a ring, a centrally located core passage, and a bypass tube disposed within and spaced apart from the core passage; providing an inlet exhaust gas manifold with a first flow conduit in fluidic connection with the bypass tube and a second flow conduit, parallel to the first flow conduit, in fluidic connection with a toroidal conduit, the toroidal conduit being in fluidic connection with the plurality of gas cooling passages; providing an actuator controlling a first valve disposed within the first flow conduit and a second valve disposed within the second flow conduit; and engaging the actuator to control the first valve and the second valve. In the method, the actuator may be engaged in response to a signal from an engine control system, such as in response to at least one input. The inputs can include engine temperature, exhaust gas temperature, engine load or exhaust gas emissions concentrations.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
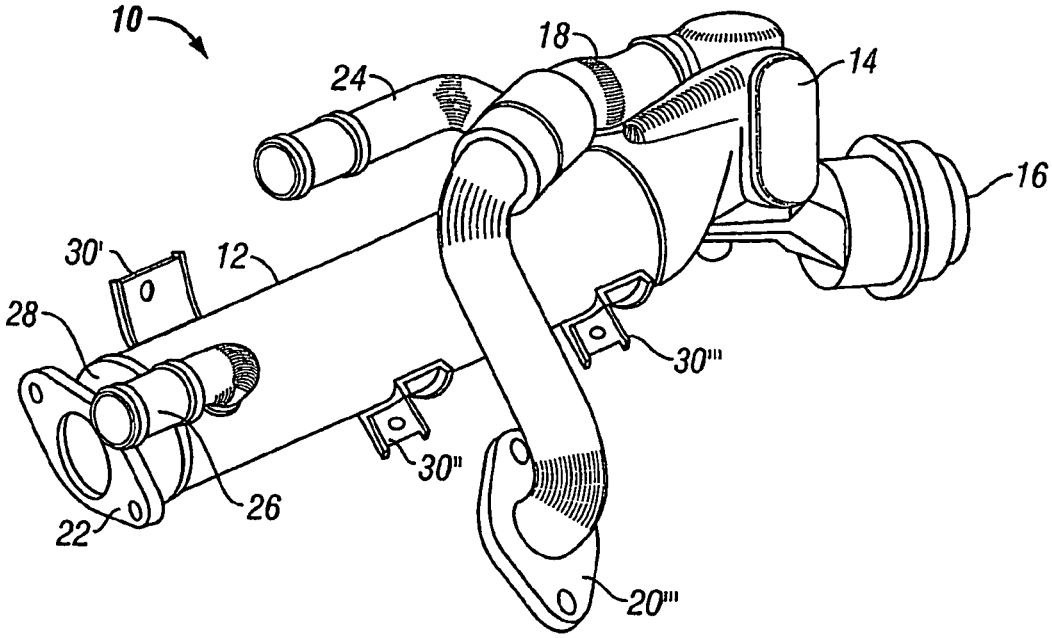
FIG. 1 is a perspective view of an exhaust gas cooler assembly of the present invention.

With reference to FIG. 1, there is shown an exhaust gas cooler assembly 10, including exhaust gas cooler 12 with an internal bypass. The cooler 12 has intake manifold and valve assembly 14 at a first end of cooler 12, the intake manifold and valve assembly 14 further including valve actuator 16. Exhaust gas enters the intake manifold and valve assembly 14 by means of exhaust gas inlet pipe 18 connected to intake flange 20. It is to be understood that exhaust gas inlet pipe 18 is generally curved, and may include one or more connectors or extenders, and is configured to fit within the engine compartment of a specific engine. Intake flange 20 is configured to be removably attachable to the exhaust manifold, directly or through one or more intermediate components. The cooler 12 has a coolant inlet passage 24 and a coolant outlet passage 26, and is connected, by means of pipes, hoses or other conduits, to a circulating coolant source. Typically the coolant source is the engine coolant, such as conventional antifreeze or other coolant, which is circulated by means of a pump associated with the internal combustion engine. However, the coolant source may be any source of fluidic coolant, which may be a liquid or gas, provided only that it is of such a temperature and has suitable heat transfer characteristics that it functions as a coolant. Outlet manifold 28 is disposed at a second end of cooler 12, and is connected to outlet flange 22, which in turn is connected to a pipe, hose or other conduit for delivering exhaust gas to the EGR circuit, such as for delivery to an intake manifold of the internal combustion engine (not shown). Cooler 12 further includes one or more brackets 30', 30", 30'", utilized to fasten and secure exhaust gas cooler assembly 10 within the engine compartment.

Figure 2:
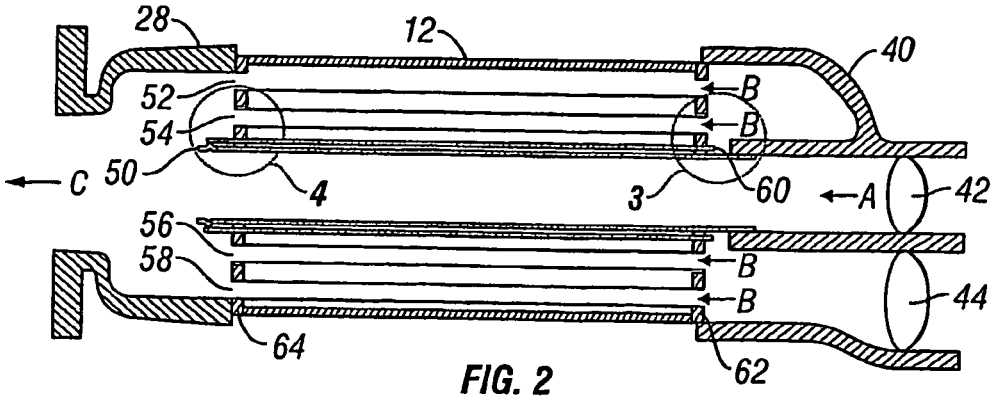
FIG. 2 is a cross-section view of an exhaust gas cooler assembly of the present invention.
Figure 3:
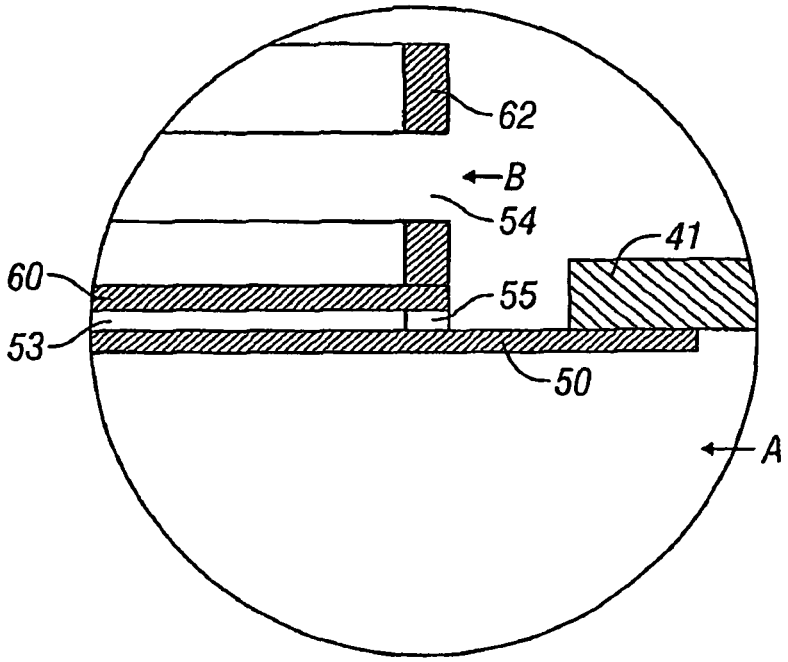
FIG. 3 is a cross-section view of a portion of the bypass tube at the intake manifold of the cooler of FIG. 2.

FIG. 2 is a midline cross section of a first embodiment of exhaust gas cooler assembly 10. Concentric flow intake manifold 40 includes butterfly valve 42, controlling flow to bypass tube 50, and butterfly valve 44, controlling flow to a plurality of gas cooling passages 52, 54, 56, 58. Gas cooling passages 52, 54, 56, 58 are connected, on the inlet side, to circular tube plate 62, and on the outlet side to circular tube plate 64. Core passage 60 is further connected to circular tube plates 62, 64. The connections between core passage 60 and circular tube plates 62, 64, and between gas cooling passages 52, 54, 56, 58 and circular tube plates 62, 64, are preferably fluid tight connections, such that pressurized coolant may flow within the spaces between gas cooling passages 52, 54, 56, 58 without leakage. Disposed within core passage 60, and preferably separated therefrom by defined air gap 53, is bypass tube 50, which on the inlet side is connected to portion 41 of concentric flow intake manifold 40, as shown in FIG. 3. On the exhaust gas inlet side, spacer 55 spaces bypass tube 50 away and apart from core passage 60. On the exhaust gas outlet side, dimple 51 spaces bypass tube 50 away and apart from core passage 60. It may be seen that either a spacer may be employed, which may be continuously around bypass tube 50, or a series of dimples 51 may be employed.

In a second embodiment, at each of the inlet and outlet ends of bypass tube 50 there are disposed three or more equally spaced dimples 51, such that bypass tube 50 is fixed and spaced apart a determined distance from core passage 60, thereby defining air gap 53. In a preferred embodiment, bypass tube 50 is fixed with respect to core passage 60 in all orientations other than axial. In another embodiment, dimples 51 are disposed on the outlet end of bypass tube 50, in contact with core passage 60, with bypass tube 50 held in place on the inlet end solely by means of the interconnection to portion 41 of concentric flow intake manifold 40. Alternatively, dimples or other surface manipulations for location of bypass tube 50 relative to core passage 60 may be a feature of core passage 60. While dimple 51 is depicted, which may be formed, for example, by means of a press, it is to be understood that the function may be performed by other forms of spacers, which may be pressed, machined or made by other means. Preferably dimple 51 or other spacer has as small a contact area with core passage 60 as is mechanically feasible. It is further preferred to employ no more spacers than is required to space bypass tube 50 away and apart from core passage 60. If only dimples or other spacers are employed, in one preferred embodiment bypass tube 50 has three radially disposed and equally spaced dimples or spacers at each end of bypass tube 50 in contact with the inner surface of core passage 60.

Figure 4:
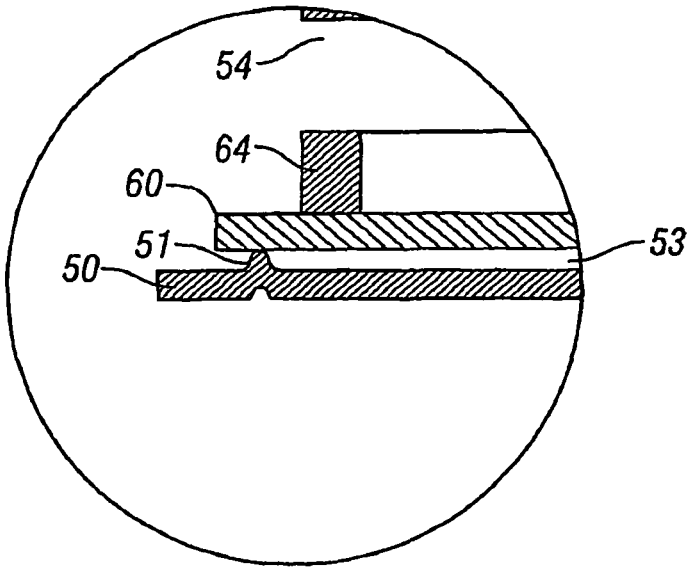
FIG. 4 is a cross-section view of a portion of the bypass tube at the exhaust manifold of the cooler of FIG. 2.

In order to minimize wear potentially leading to a coolant leak, it is preferred to have dimple 51, or other spacer means spacing bypass tube 50 relative to core passage 60, located at a point external to tube plates 62, 64, as is shown in FIG. 4. This prevents cross contamination of fluids in the event of wear to core passage 60 by means of abrasion or other failure modes. However, the spacer means may be located anywhere along the length of bypass tube 50, or if preferred, core passage 60.

The user of spacer means spacing bypass tube 50 relative to core passage 60, with air gap 53 defined therebetween, permits exhaust gas to pass through cooler 12 while minimizing loss of temperature; such thermal isolation resulting from the lack of direct contact between the bypass tube 50 and the coolant, contained by core passage 60. The user of spacer means further allows for thermal expansion and contraction without inducing significant stresses into the components.

As shown in FIG. 2, valves 42, 44 may be positioned such as to allow exhaust gas to flow only through bypass tube 50 as shown by directional arrow A, to flow only through gas cooling passages 52, 54, 56, 58 as shown by directional arrow B, or a combination thereof, with gases commonly exiting through exhaust manifold 28 as shown by directional arrow C. In one preferred embodiment, valves 42, 44 are disposed along a common axis, with one butterfly flap disposed at a right angle with respect to the other butterfly flap. By applying rotational energy along the axis, the axis may be rotated such that valve 44 is closed while valve 42 is opened, or conversely, such that valve 44 is open while valve 42 is closed. It is also possible and contemplated that both valves 42 and 44 may be in a partially opened position, such that exhaust gas flows along the paths shown by both directional arrows A and B.

When in partial or full bypass operation mode, such that valve 42 is partially or fully open, bypass tube 50 will increase in temperature significantly over the body of cooler 12. This gives rise to thermal expansion, which on a conventional cooler design would subject the cooler to stress, particularly axially, where core passage 60 connects to tube plates 62, 64. However, by means of dimple 51 or other spacer means, bypass tube 50 is rigidly connected at only one end (as shown in FIG. 3), or is not rigidly connected at either end, such as by means of dimples 51 at each end thereof. This permits axial expansion and contraction of bypass tube 50 without inducing stress.

Figure 5:
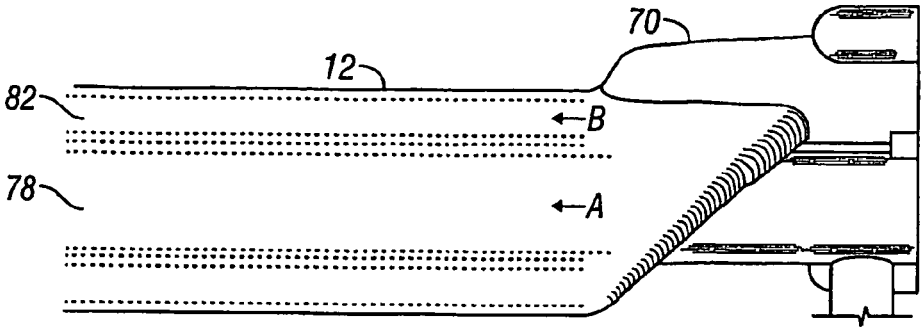
FIG. 5 is a perspective view of the intake manifold of an exhaust gas cooler of the present invention, with exhaust gas flow indicated within the exhaust gas cooler.
Figure 6:
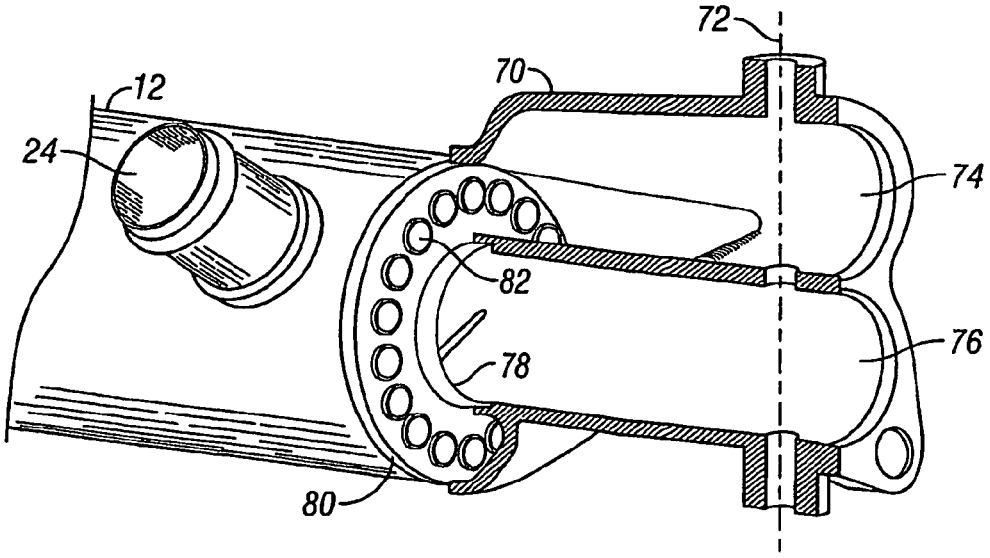
FIG. 6 is a partially cut away side perspective view of an intake manifold and valve embodiment of the present invention.
Figure 7:
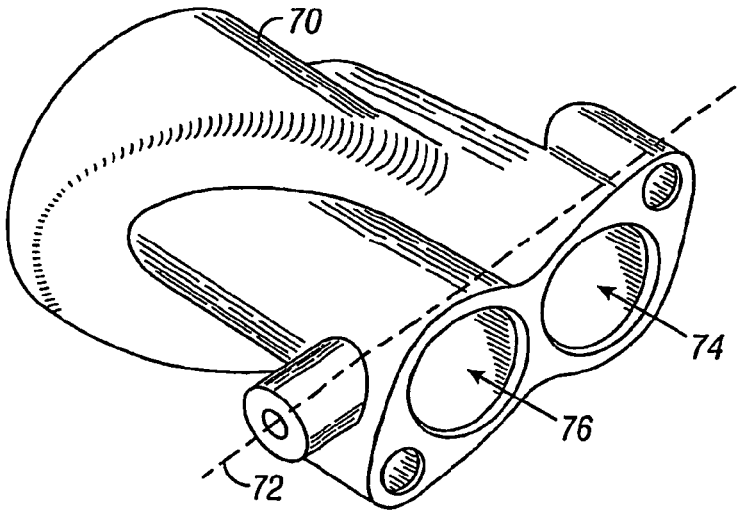
FIG. 7 is a perspective view of an intake manifold and valve embodiment of the present invention.
Figure 11:
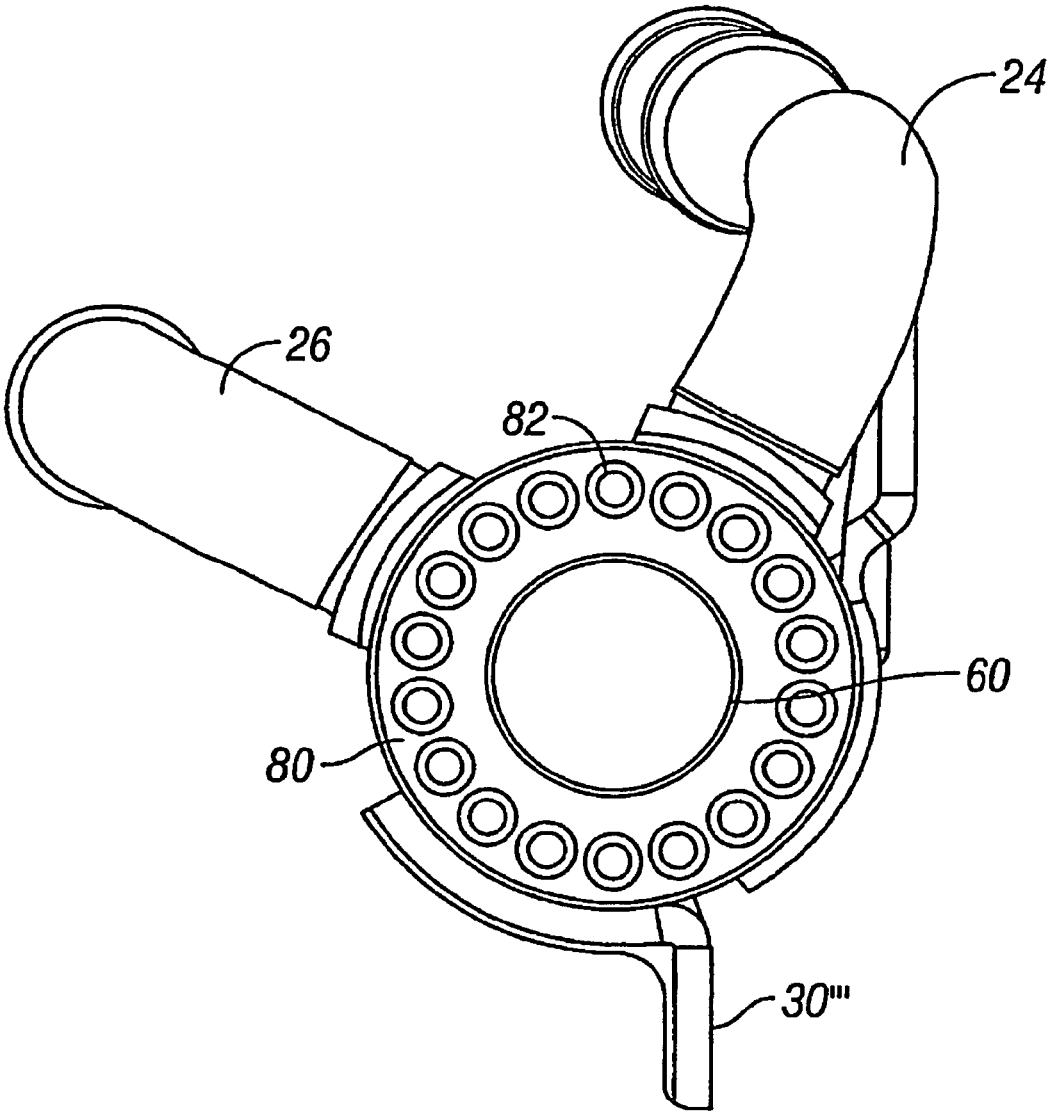
FIG. 11 is an end view of the exhaust gas cooler passage plates of an exhaust gas cooler of the present invention.

FIGS. 5, 6 and 7 illustrate aspects of an embodiment of concentric flow intake manifold 70, employed with a plurality of a single row of concentric gas cooling passages 82, with a centrally located bypass tube 78, as shown in FIG. 6. The butterfly valves (not shown) are disposed along common axis 72, such that the valves are coaxial, with intake manifold 70 defining bypass inlet 76 and cooling passage inlet 74, both connectably engaged with tube plate 80. Also shown is coolant inlet 24, forming a part of cooler 12. FIG. 11 depicts an end view of tube plate 80, showing a plurality of cooling passages 82 disposed around core passage 60, with coolant inlet 24 and outlet 26, together with brackets 30'", also shown.

Figure 8:
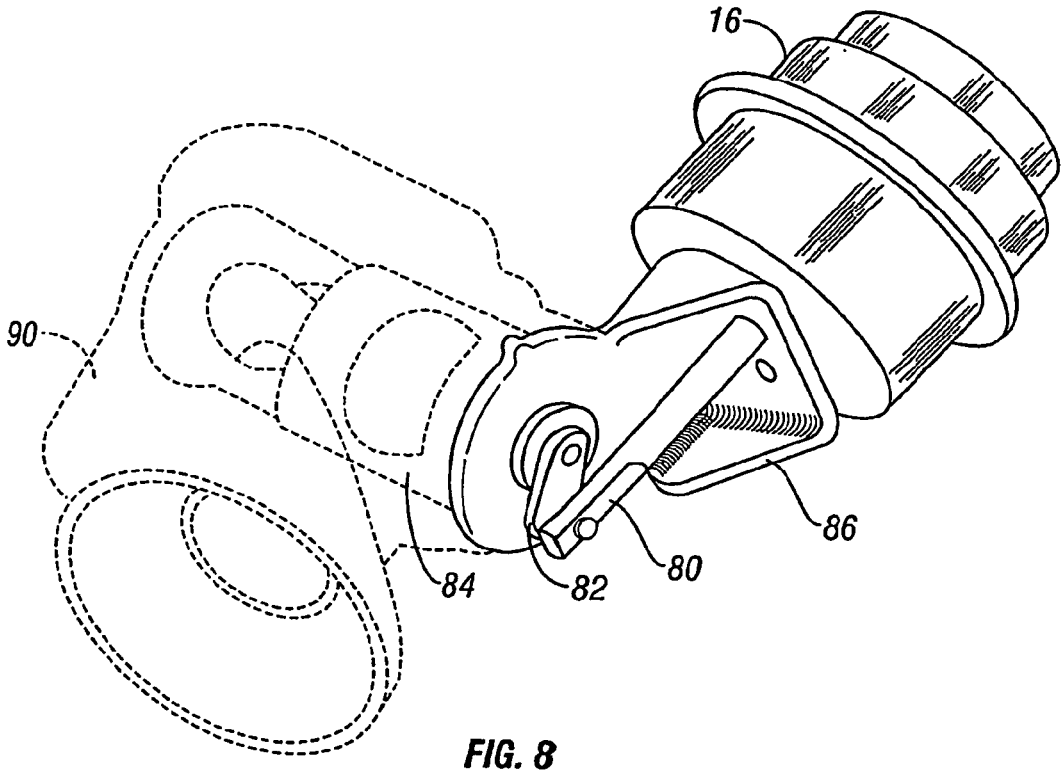
FIG. 8 is a perspective view of a removable valve cartridge embodiment of the present invention, fitted in an intake manifold.
Figure 9:
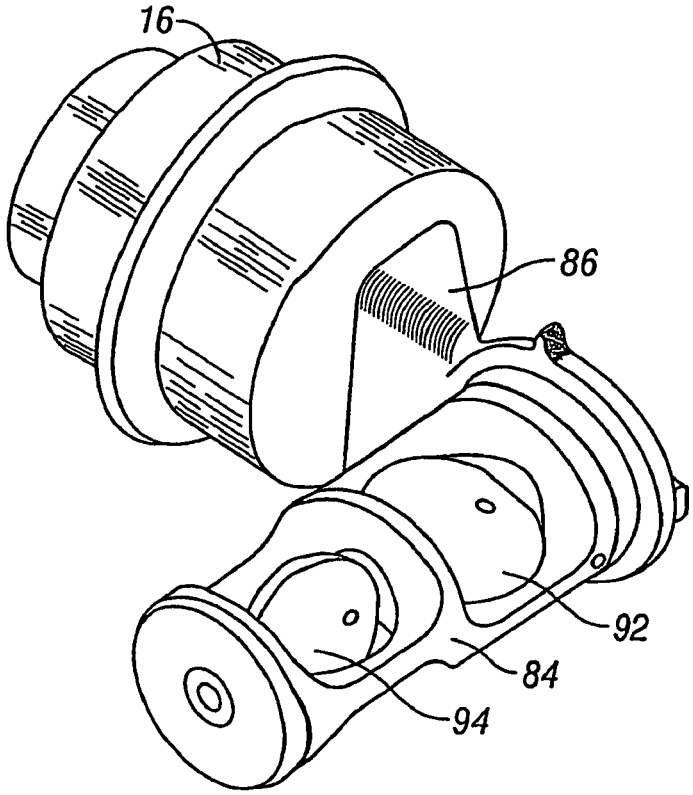
FIG. 9 is a perspective view of a removable valve cartridge embodiment of the present invention.
Figure 10:
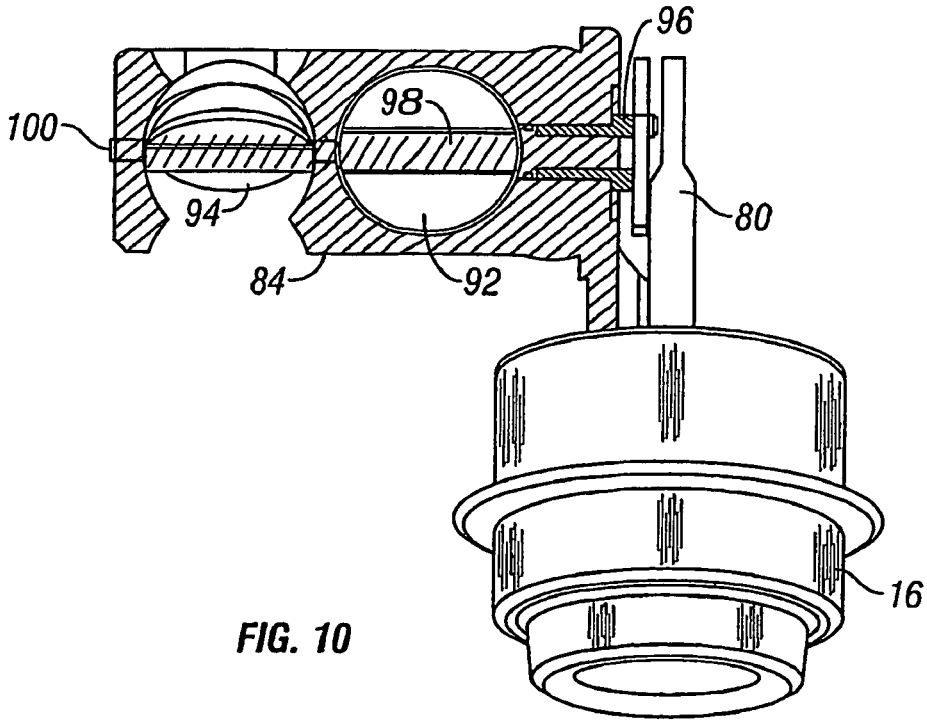
FIG. 10 is a sectional view of a removable valve cartridge embodiment of the present invention.

FIGS. 8, 9 and 10 illustrate a further embodiment wherein a detachable valve cartridge 84 is provided, inserted within a reciprocal bore on concentric flow intake manifold 90. Preferably valve cartridge 84 is cylindrical in shape, fitting within a reciprocal cylindrical bore. Valve cartridge 84 contains butterfly valves 92, 94 connected to spindle 98. Spindle 98 is rotatably engaged by means of cylindrical hole 100, with spindle 98 transiting through bushing 96 and connected to crank assembly 82, driven in turn by rod 80 connected to actuator 16. Actuator 16 is fixed relative to valve cartridge 84 by means of bracket 86, it being understood that retaining clips or other fastening means are employed to fasten actuator 16 and valve cartridge 84 to bracket 86.

As in the previous embodiments, preferably butterfly valve 92 is disposed along spindle 98 at a right angle to butterfly valve 94, such that in operation when valve 92 is open valve 94 is closed, and when valve 92 is closed valve 94 is open.

Actuator 16 is preferably in communication with one or more sensors, and optionally a control system, which sensors control the actuator 16. Actuator 16 is preferably operated by means of a pneumatic vacuum mechanism, but may also be operated by positive pressure, electric or other mechanisms. Actuator 16, in response to an appropriate signal, operates the valves, such as butterfly valves 92, 94, such that if cooling of the exhaust gas is desired, valve 94 is opened and valve 98 is closed, such that exhaust gas is directed to flow through the plurality of gas cooling passages, and not through the bypass tube. Alternatively, if cooling of exhaust gas is not desired, then the valves are positioned by actuator 16 such that exhaust gas is directed to flow through the bypass tube, and not through the plurality of gas cooling passages. Sensors, which may be operably linked to actuator 16 directly or through one or more intermediate structure, such as a control system, may detect engine temperature, preferably at more than one point, exhaust temperature, intake temperature, load and the like. The control system may further include preset or programmable control circuits, specifying actuator 16 engagement based on determined parameters and desired emissions compliance.

In one embodiment the invention thus provides for channelling of parallel flows of inlet exhaust gas, controllable by a double coaxial valve, into two concentric flows of gas flow, one directed to the bypass and the other directed to cooling passages. The one piece manifold to direct the flows thus enables use of a simple valve design. In general, flows through the cooler are concentric, and thus would be difficult to valve by conventional means. The outer portion of the cooler flow, which enters the cooler passages, is diverted around the inner bypass in a toroid-like geometry that results in the cooler passage running parallel to the internal bypass tube.

The internal bypass tube may be centrally disposed within a concentric array of gas cooling passages, as shown in FIG. 11. However, other geometric arrangements are possible and contemplated by the invention. For example, it is possible to provide gas cooling passages on one side of a cooler, with the bypass tube located on another side of the cooler. Similarly, while the cooler may conventionally be cylindrical, other shapes are possible, such that the cooler cross section may be oval, square, rectangular or other shapes.

Two valves to control two separate flows or a flow diverter are typically expensive, hard to package in a customer installation and complex. Arranging the flows in a coaxial configuration allows a valve design which is operated by a single shaft axis on which both valves are mounted. Simple butterfly valves may be employed, in that leakage around the valves in the bore is not critical, but alternative valve configurations known in the art could similarly be implemented.

By providing for removable valve cartridge 84, problems associated with machine finishing and brazing the valves within manifold 70 (or any other similar manifold or component) are alleviated. Valve components may become deformed and degraded in a brazing process when the valves form a part of a larger structure, and depending on the configuration, post braze machining may not be feasible. Thus in one embodiment these and related problems are resolved by assembly of all the moving valve components and bushings into a single component, valve cartridge 84. It may be seen that post braze assembly of all the moving parts of the valve into a cooler is readily facilitated, and an entire valve component can be fully assembled, finished and tested prior to installation. Valve cartridge 84 may be cast from stainless steel or another steel alloy, machined, or made by other means. Preferably valve cartridge 84 is machined in a cylindrical form, which may easily placed into a bore on intake manifold 90, or may be located upstream of the manifold, if desired. Once assembled into the cooler or a part thereof, valve cartridge 84 may be retained by use of a press fit, a clip, or by use of simple fixing means, such as a small screw or rivet. Advantageously valve cartridge 84 is not subject to the braze process, and thus problems resulting from distortion due to the very high temperatures required for brazing are eliminated. Additionally, the majority of machining is conveniently contained in one component, valve cartridge 84. It may further be seen that by this means valve cartridge 84 may readily be removed, such that the exhaust gas cooler may be easily serviced in the event of valve or actuator failure.

In any of the embodiments, cooler 12 is conventionally cylindrical in shape, with a circular cross section. However, cooler 12 may alternatively have an oval, rectangular or other cross section, depending in part on the specific application and the space requirements for the intake manifold and valve assembly. Similarly, while gas cooling passages 52, 54, 56, 58 and 82 are shown as cylindrical tubes, with a circular cross section, it is to be appreciated that other geometric configurations of passages or conduits may be employed. For example, the gas cooling passages may be spiral tubes, thereby increasing the surface area of the tube for unit distance length as compared to a cylindrical tube, and thus resulting in greater heat transfer, and further inducing turbulence in the exhaust flow to improve heat transfer by mixing the exhaust gas. The gas cooling passages may further include fins, projections or other modifications intended to increase heat transfer.

The components of the intake manifold and valve assembly are conventionally made from steel, such as a stainless steel or other steel alloy. In one embodiment, a corrosion resistant stainless steel without traces of lead, cadmium, mercury or hexavalent chromium is employed. Depending on the component, the component may be fabricated from sheet material, milled from solid stock, or made by other means known in the art. Components may be assembled by any of a variety of methods; one method employed utilizes tack welding, such as by a tungsten inert gas method, to fix components together, followed by furnace brazing.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

What is claimed is:

1. An exhaust gas cooler assembly, comprising:

a cooler shell including a first end with a cooler inlet proximate the first end, and a second end with a cooler outlet proximate the second end;

a plurality of gas cooling passages extending from the first end of the cooler shell to the second end of the cooler shell;

a core extending from the first end of the cooler shell to the second end of the cooler shell; and a bypass tube disposed within and spaced apart from the core;

wherein the bypass tube is supported within the core at a first end of the bypass tube by a plurality of dimples on the bypass tube, the dimples forming slidable supports configured to permit axial expansion and contraction of the bypass tube with respect to the core.

2. The exhaust gas cooler assembly of claim 1, wherein the bypass tube is rigidly held with respect to the core at a second end of the bypass tube.

3. A method of controlling exhaust gas temperature within an exhaust gas recirculation circuit, the method comprising:

providing the exhaust gas cooler assembly of claim 1; and actuating a valve assembly actuator that is configured to control the flow of exhaust gas between the plurality of gas cooling passages and the bypass tube based on a set of determined parameters.

4. The method of claim 3, wherein the desired parameters are emission compliance parameters.

5. An exhaust gas cooler assembly, comprising:

a cooler shell including a first end with a cooler inlet proximate the first end, and a second end with a cooler outlet proximate the second end;

a plurality of as cooling passages extending from the first end of the cooler shell to the second end of the cooler shell;

a core extending from the first end of the cooler shell to the second end of the cooler shell; and a bypass tube disposed within and spaced apart from the core;

wherein the bypass tube is supported within the core at a first end of the bypass tube by a plurality of slidable supports configured to permit axial expansion and contraction of the bypass tube with respect to the core, and wherein the bypass tube is supported within the core at a second end of the bypass tube by a second plurality of slidable supports to permit axial expansion and contraction of the bypass tube with respect to the core.

6. An exhaust gas cooler assembly, comprising:

a cooler shell including a first end with a cooler inlet proximate the first end, and a second end with a cooler outlet proximate the second end;

a plurality of gas cooling passages extending from the first end of the cooler shell to the second end of the cooler shell;

a core extending from the first end of the cooler shell to the second end of the cooler shell; and a bypass tube disposed within and spaced apart from the core;

wherein the bypass tube is supported within the core at a first end of the bypass tube by a plurality of slidable supports configured to permit axial expansion and contraction of the bypass tube with respect to the core, and wherein the core is characterized by an intermediate portion forming a wall defining the axial extent over which coolant is in contact with the core, and wherein the slidable supports are axially outside of the intermediate portion of the core.

7. An exhaust gas cooler assembly comprising:

a cooler shell including a first end with a cooler inlet proximate the first end and a second end with a cooler outlet proximate the second end;

a plurality of gas cooling passages extending from the first end of the cooler shell to the second end of the cooler shell;

a core passage extending from the first end of the cooler shell to the second end of the cooler shell;

a bypass tube disposed within and spaced apart from the core passage; and an inlet exhaust gas manifold at the first end of the cooler shell, including a toroidal flow portion in fluidic connection with the plurality of gas cooling passages, a central flow portion in fluidic connection with the bypass tube, a first flow conduit in fluidic connection with the central flow portion, and a parallel second flow conduit in fluidic connection with the toroidal flow portion, and a valve assembly configured to selectably control an exhaust gas flow to the plurality of gas cooling passages, to the bypass tube, or to a combination thereof.

8. The exhaust gas cooler assembly of claim 7 wherein the valve assembly controls flow at the first flow conduit and the second flow conduit.

9. An exhaust gas cooler assembly, comprising:

a cooler shell including a first end with a cooler inlet proximate the first end, and a second end with a cooler outlet proximate the second end;

a plurality of gas cooling passages extending from the first end of the cooler shell to the second end of the cooler shell;

a core extending from the first end of the cooler shell to the second end of the cooler shell;

a bypass tube disposed within and spaced apart from the core;

an inlet exhaust gas manifold at the first end of the cooler shell, the inlet exhaust gas manifold including a first flow conduit in fluid communication with the plurality of gas cooling passages, and a separate, second flow conduit in fluid communication with the bypass tube, wherein the inlet exhaust gas manifold defines a bore; and a valve assembly removably received within the bore of the inlet exhaust gas manifold, the valve assembly being configured to move between a plurality of valve positions including a first position configured to direct exhaust gas flow substantially through only the first flow conduit to the plurality of gas cooling passages, and a second position configured to direct exhaust gas flow substantially through only the second flow conduit to the bypass tube;

wherein the bypass tube is supported within the core at a first end of the bypass tube by a plurality of slidable supports configured to permit axial expansion and contraction of the bypass tube with respect to the core.

10. The exhaust gas cooler assembly of claim 9, wherein the valve assembly comprises two coaxial butterfly valves including a first butterfly valve disposed within the first flow conduit and a second butterfly valve disposed within the second flow conduit.

11. The exhaust gas cooler assembly of claim 10, wherein the second flow conduit is a central flow conduit, and wherein the first flow conduit is a toroidal flow conduit surrounding the second flow conduit, and is configured to provide exhaust gas to exhaust gas cooling passages surrounding the bypass tube.

12. An exhaust gas inlet for use with an exhaust gas cooler assembly that includes a cooler shell having a first end with a cooler inlet proximate the first end and a second end with a cooler outlet proximate the second end, a plurality of gas cooling passages extending from the first end of the cooler shell to the second end of the cooler shell, a core extending from the first end of the cooler shell to the second end of the cooler shell, a bypass tube disposed within and spaced apart from the core, comprising:

an inlet exhaust gas manifold configured to attach to the first end of the cooler shell, the inlet exhaust gas manifold including a first flow conduit configured to be in fluid communication with the plurality of gas cooling passages when the exhaust gas manifold is attached to the first end of the cooler shell, and a separate, second flow conduit configured to be in fluid communication with the bypass tube when the exhaust gas manifold is attached to the first end of the cooler shell, wherein the inlet exhaust gas manifold defines a bore; and a valve assembly removably received within the bore of the inlet exhaust gas manifold, the valve assembly being configured to move between a plurality of positions including a first position configured to direct exhaust gas flow substantially through only the first flow conduit to the plurality of gas cooling passages, and a second position configured to direct exhaust gas flow substantially through only the second flow conduit to the bypass tube.

13. The exhaust gas inlet of claim 12, wherein the second flow conduit is a central flow conduit, and wherein the first flow conduit is a toroidal flow conduit surrounding the second flow conduit, and is configured to provide exhaust gas to exhaust gas cooling passages surrounding the bypass tube.

14. The exhaust gas inlet of claim 12, wherein:

the bore extends through the first flow conduit and the second flow conduit;

the valve assembly is configured to separately control flow rates at the first flow conduit and the second flow conduit;

the valve assembly comprises two coaxial butterfly valves including a first butterfly valve disposed within the first flow conduit and a second butterfly valve disposed within the second flow conduit;

the second flow conduit is a central flow conduit; and the first flow conduit is a toroidal flow conduit surrounding the second flow conduit, and is configured to provide exhaust gas to the exhaust gas cooling passages surrounding the bypass tube.

15. The exhaust gas inlet of claim 12, wherein:

the bore extends through the first flow conduit and the second flow conduit; and the valve assembly is configured to separately control flow rates at the first flow conduit and the second flow conduit.

16. The exhaust gas inlet of claim 15, wherein the valve assembly comprises two coaxial butterfly valves including a first butterfly valve disposed within the first flow conduit and a second butterfly valve disposed within the second flow conduit.

* * * * *